US009052158B2

(12) United States Patent
Piazza et al.

(10) Patent No.: US 9,052,158 B2
(45) Date of Patent: Jun. 9, 2015

(54) GUN SIGHT FOR USE WITH SUPERELEVATING WEAPON

(71) Applicant: General Dynamics Armament and Technical Products, Inc., Charlotte, NC (US)

(72) Inventors: Jonathan Piazza, Burlington, VT (US); Theodore E Bloomhardt, Hinesburg, VT (US); John Grover Fletcher, III, Richmond, VT (US); Vladimir G. Krylov, Brookline, NH (US); Craig N. Pepper, Shelburne, VT (US); Peter C Wolff, Georgia, VT (US)

(73) Assignee: General Dynamics—OTS, Inc., St. Petersburg, FL (US)

( * ) Notice: Subject to any disclaimer, the term of this patent is extended or adjusted under 35 U.S.C. 154(b) by 0 days.

(21) Appl. No.: 13/688,779

(22) Filed: Nov. 29, 2012

(65) Prior Publication Data

US 2014/0103112 A1 Apr. 17, 2014

Related U.S. Application Data

(60) Provisional application No. 61/565,296, filed on Nov. 30, 2011.

(51) Int. Cl.
*G06F 19/00* (2011.01)
*G06G 7/80* (2006.01)
(Continued)

(52) U.S. Cl.
CPC *F41G 1/00* (2013.01); *F41G 3/165* (2013.01); *F41G 3/06* (2013.01); *F41G 1/473* (2013.01); *F41G 1/50* (2013.01); *F41G 3/00* (2013.01)

(58) Field of Classification Search
CPC ..... F41G 3/06; F41G 3/16; F41G 3/165; F41G 1/02; F41G 1/54; F41G 1/38; F41G 3/00; F41G 3/065; F41G 3/147; F41G 3/2605; F41G 3/2611; F41G 3/323; F41G 3/326; F41G 7/2253; F41G 7/2293; G02B 23/14; G02B 27/64; G02B 27/36; G02B 27/642; G03B 13/02
USPC ..... 235/440, 400–408
See application file for complete search history.

(56) References Cited

U.S. PATENT DOCUMENTS 2,538,821 A 1/1951 Wheeler
4,760,770 A 8/1988 Bagnall-Wild et al.
(Continued)

OTHER PUBLICATIONS

PCT International Search Report and Written Opinion mailed Aug. 8, 2013 in PCT/US12/67084.
(Continued)

*Primary Examiner* — Tuyen K Vo
(74) *Attorney, Agent, or Firm* — Ingrassia, Fisher & Lorenz, P.C.

(57) ABSTRACT

A gun sight is disclosed herein for use with a weapon configured for superelevation. The gun sight includes, but is not limited to, an imaging system configured to capture an image of an area down range of the imaging system, to display the image on a display unit having a display, and further configured to rotate in elevation. The gun sight further includes, but is not limited to, a drive mechanism configured to rotate the imaging system. The gun sight still further includes, but is not limited to, a processor communicatively coupled with the drive mechanism and with the imaging system, the processor configured to receive information from the imaging system relating to the image and to control the drive mechanism based on the information to rotate the imaging system in a manner that causes the image to remain on the display when the weapon is superelevated.

18 Claims, 7 Drawing Sheets

(51) Int. Cl.

| | |
|---|---|
| ***F41G 1/00*** | (2006.01) |
| ***F41G 3/16*** | (2006.01) |
| ***F41G 3/06*** | (2006.01) |
| ***F41G 1/473*** | (2006.01) |
| ***F41G 1/50*** | (2006.01) |
| ***F41G 3/00*** | (2006.01) |

(56) References Cited

U.S. PATENT DOCUMENTS

| | | | | |
|---|---|---|---|---|
| 4,876,942 | A | 10/1989 | Nilsson | |
| 5,171,933 | A | 12/1992 | Eldering | |
| 5,456,157 | A | 10/1995 | Lougheed et al. | |
| 5,686,690 | A * | 11/1997 | Lougheed et al. | 89/41.17 |
| 6,349,477 | B1 | 2/2002 | Hunter | |
| 6,499,382 | B1 | 12/2002 | Lougheed et al. | |
| 7,698,986 | B2 | 4/2010 | Persson et al. | |
| 7,946,212 | B1 | 5/2011 | Quinn | |
| 2004/0009798 | A1 * | 1/2004 | Okuda et al. | 463/7 |
| 2008/0107414 | A1 * | 5/2008 | Showalter | 396/429 |
| 2009/0040308 | A1 * | 2/2009 | Temovskiy | 348/158 |
| 2009/0139393 | A1 * | 6/2009 | Quinn | 89/41.18 |
| 2010/0275768 | A1 | 11/2010 | Quinn | |
| 2011/0288804 | A1 * | 11/2011 | Lee et al. | 702/87 |
| 2012/0159833 | A1 | 6/2012 | Hakanson et al. | |

OTHER PUBLICATIONS

PCT International Search Report and Written Opinion mailed Aug. 8, 2013 in PCT/US12/67088.

The International Bureau of WIPO, International Preliminary Report on Patentability for International Application No. PCT/US2012/067084, mailed Jun. 12, 2014.

The International Bureau of WIPO, International Preliminary Report on Patentability for International Application No. PCT/US2012/067088, mailed Jun. 12, 2014.

USPTO, Office Action for U.S. Appl. No. 13/688,946, mailed Jun. 18, 2014.

United States International Searching Authority, International Search Report and Written Opinion for International Application No. PCT/US 14/25238, mailed Nov. 18, 2014.

USPTO, Notice of Allowance and Fee(s) Due for U.S. Appl. No. 13/688,946, mailed Jan. 22, 2015.

* cited by examiner

GUN SIGHT FOR USE WITH SUPERELEVATING WEAPON

CLAIM OF PRIORITY

This application claims the benefit of U.S. Provisional Application No. 61/565,296 which was filed on Nov. 30, 2011, which is hereby incorporated herein by reference in its entirety.

TECHNICAL FIELD

The present invention generally relates to weapons and more particularly to a gun sight for use with a weapon configured for superelevation.

BACKGROUND

For some weapons, such as grenade launching machine guns which fire relatively slow rounds, it is necessary to elevate the weapon by a significant angle above the line of sight to the target (e.g., by an angle greater than half the field of view of the gun sight) in order to reach the target with the grenade round. Such weapons are often used in conjunction with a gun sight that is coupled with a display that presents an image of a down range area that includes the target. An aiming reticle is often displayed on the display, the position of which is calculated by a ballistic algorithm, to assist the user in aiming the weapon and engaging an object down range.

Modern gun sights have high levels of magnification that permit precise aiming of the weapon at long ranges. Such gun sights provide a field of view of only a few degrees. When a targeting solution is determined that requires superelevation, the gun sight may be elevated together with the weapon and the target will very likely move off of the display when the required superelevation exceeds the field of view. This loss of visual contact with the target during superelevation is undesirable.

One solution to this problem was described in U.S. Pat. No. 6,499,382 issued to Lougheed et al. Lougheed describes a grenade machine gun or other weapon that employs superelevation of the barrel and an aiming system. The aiming system is mounted to both the weapon and the weapon's support or base. The aiming system is configured to alternatively lock to either the weapon or to the weapon's support. When locked to the weapon, the aiming system is free to rotate in elevation and azimuth in unison with the weapon. When locked to the weapon support, the aiming system is restrained from elevation and thus the weapon can be superelevated while the aiming system remains oriented at a static elevation angle. In this manner, the weapon can be superelevated yet still allow a user to maintain visual contact with the target on the display.

While this solution is adequate, there is room for improvement. For example, Lougheed's aiming system is large and has substantial mass. Additionally, systems constructed in accordance with Lougheed's disclosure have historically been very expensive. Also, in some circumstances, it may not be sufficient or desirable to lock the aiming system into a static elevation angle with respect to the weapon support. For example, the terrain may be sandy or muddy or otherwise unstable. On such terrain, superelevation of the weapon or other circumstances may cause the weapon support to shift. This, in turn, would cause an unintended deviation of the aiming system and possibly a loss of line of sight to the target. Furthermore, by having the gun sight attach to the weapon mount, the gun sight is less adaptable for use with different weapons. A less massive, less expensive gun sight that is not statically locked to the weapon's base during superelevation and that provides greater adaptability for use with multiple weapons is desired. Furthermore, other desirable features and characteristics of the present disclosure will become apparent from the subsequent detailed description and the appended claims, taken in conjunction with the accompanying drawings and the foregoing technical field and background.

BRIEF SUMMARY

A gun sight is disclosed herein for use with a weapon configured for superelevation.

In a first non-limiting embodiment, the gun sight includes, but is not limited to an imaging system configured to capture an image of an area down range of the imaging system, to display the image on a display unit, and further configured to rotate in elevation. The gun sight further includes, but is not limited to, a drive mechanism configured to rotate the imaging system. The gun sight still further includes, but is not limited to, a processor that is communicatively coupled with the drive mechanism and with the imaging system. The processor is configured to receive information from the imaging system relating to the image, and to control the drive mechanism based on the information to rotate the imaging system in a manner that causes the image to remain on the display when the weapon is superelevated.

In another embodiment, the gun sight includes, but is not limited to, an imaging system configured to capture an image of an area down range of the imaging system, to display the image on a display unit having a display, and further configured to rotate in elevation. The gun sight further includes, but is not limited to, a drive mechanism configured to rotate the imaging system. The gun sight further includes an input unit configured to transmit a signal indicative of an initiation of superelevation. The gun sight still further includes, but is not limited to, a processor that is communicatively coupled with the imaging system and the drive mechanism and the input unit. The processor is configured to receive the signal from the input unit, to receive information from the imaging system relating to the image, and to control the drive mechanism based on the information to rotate the imaging system in a manner that causes the image to remain on the display when the processor receives the signal.

In another embodiment, a module is disclosed for use with a gun sight. The gun sight is configured for use with a weapon capable of superelevation. The weapon includes a display unit having a display. The gun sight includes an imaging system configured to capture an image of an area downrange of the imaging system and to display the image on the display, and further configured for rotation. The gun sight further includes a drive mechanism configured to rotate the imaging system. The module includes, but is not limited to, a processor and an electronic memory unit. The module is adapted to communicatively couple with the imaging system and the drive mechanism. The processor and the electronic memory unit are configured to cooperate to receive information from the imaging system relating to the image, and to control the drive mechanism based on the information to rotate the imaging system in a manner that causes the image to remain on the display when the weapon is superelevated.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
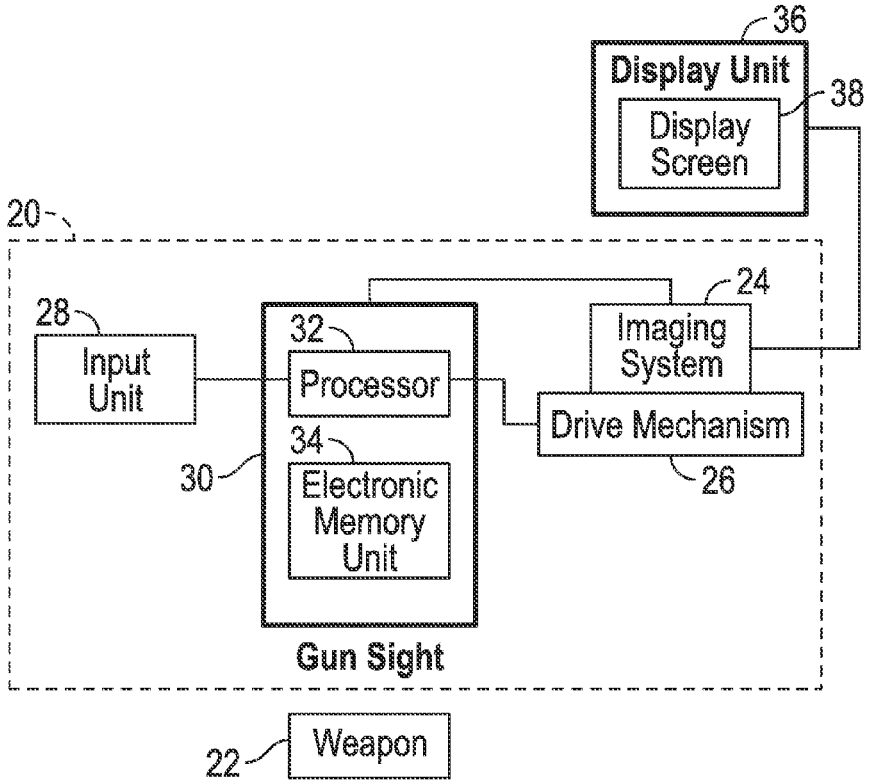
FIG. 1 is a block diagrammatic view illustrating a non-limiting embodiment of a gun sight made in accordance with the teachings of the present disclosure.

The following detailed description is merely exemplary in nature and is not intended to limit the invention or the application and uses of the invention. Furthermore, there is no intention to be bound by any theory presented in the preceding background or the following detailed description.

An improved gun sight is disclosed herein that is configured to maintain a line of sight to the target during superelevation of the weapon. The gun sight includes an imaging system to detect an image of an area down range of the gun sight. The imaging system is adapted to communicatively couple with a display unit. The display unit may be associated with the weapon, with the gun sight, with some other component, or it may be autonomous. The imaging system is configured to control the display unit to display the image. The imaging system may be mounted to the weapon and is configured to rotate together with the weapon in azimuth. The imaging system may further be configured to rotate together with the weapon in elevation during non-superelevating changes in elevation of the weapon.

The gun sight further includes a drive mechanism that is configured to cause the imaging system to rotate in elevation with respect to the weapon. The drive mechanism may be mounted to the imaging system or to another component of the gun sight and positioned to engage the imaging system.

In some embodiments, the gun sight may further include an input unit. The input unit allows a user or another component/device to send a signal to the gun sight indicating that superelevation of the weapon has been initiated.

The gun sight further includes a processor that is communicatively coupled with the drive mechanism, the imaging system, and with the input unit. When the weapon is raised or lowered while the gun sight is not in a superelevation mode, the line of sight of the gun sight will change and this will cause movement of the image on the display. For example, when the weapon and the gun sight are elevated with respect to an object down range, the image of the object will move towards a lower portion of the display. Conversely, when the weapon and the gun sight are lowered with respect to the object, the image of the object will move towards an upper portion of the display.

Once the processor receives the signal from the input unit indicating that superelevation has begun, the image captured by the imaging system will be monitored by the processor. As the weapon is superelevated, the image will begin to shift or translate, as set forth above. In some embodiments, the processor may be configured to compare consecutive video frames of the image (either via the display or through the use of data that has been saved to video RAM or other memory device) to detect movement of the gun sight. Misalignment between two consecutive video frames is indicative of movement (e.g., vertical movement) of the gun sight and/or its imaging system and/or its line of sight. The direction of the misalignment of two consecutive image frames is indicative of the direction of such movement. When the processor detects such movement of the gun sight, the imaging system, and/or the line of sight based on the processing of consecutive video frames, the processor is configured to control the drive mechanism to rotate the imaging system in a manner that counteracts such vertical movement. When further vertical movement of the image is detected as superelevation of the weapon continues, the processor will control the drive mechanism to further rotate the imaging system to counteract such further vertical movement. In this iterative manner, the processor will cause the image of the object to remain stabilized on the display as the weapon is superelevated.

A greater understanding of the embodiments of the gun sight disclosed herein may be obtained through a review of the illustrations accompanying this application together with a review of the detailed description that follows.

FIG. 1 is a block diagram illustrating a non-limiting embodiment of a gun sight 20 for use with a weapon 22 that is configured for superelevation. Gun sight 20 may be adapted for mounting to weapon 22 such that gun sight 20 rotates in azimuth together with weapon 22 and also rotates in elevation together with weapon 22 at times other than when weapon 22 is being superelevated. By locking the rotation of gun sight 20 to that of weapon 22, the user is able to both rotate and elevate weapon 22 while looking through a view finder displaying images captured by gun sight 20, allowing the user to identify and select targets downrange. In some embodiments, weapon 22 and gun sight 20 may be bore sighted such that weapon 22 and gun sight 20 remain optically locked together in an aligned position wherein the weapon and the gun sight remain pointing at a single down range location. Weapon 22 may be any weapon that utilizes superelevation including, but not limited to mortar launchers, grenade launchers, machine grenade launchers, artillery, rifles, machine guns, and the like.

Gun sight 20 includes an imaging system 24, a drive mechanism 26, an input unit 28 and a module 30 including a processor 32 and an electronic memory unit 34. In other embodiments, gun sight 20 may include a greater number of components without departing from the teachings of the present disclosure. In some embodiments, each of the components of gun sight 20 may be enclosed in a single housing, while in other embodiments, only some of the components may be contained within a housing. In still other embodiments, each of the components may be housed separately. In some embodiments, the components of gun sight 20 may be used exclusively by gun sight 20 while in other embodiments, one or more components may be shared with weapon 22 or another device.

Imaging system 24 may comprise any suitable imaging system including, without limitation, a daytime imaging system (e.g., a video camera, television camera), a thermal imaging system, an infrared imaging system, a laser range finder, a radar system, a sonar system, or any other type of system that is configured to perceive and/or detect the presence of an object at a downrange location. In some embodiments, imaging system 24 may include only one type of imaging system while in other embodiments, imaging system 24 may include two or more types of imaging system. By including multiple types of imaging systems, a user is provided with the flexibility that may be needed to accommodate different or changing battlefield conditions such as nightfall and inclement weather.

Imaging system 24 is configured to rotate in elevation with respect to weapon 22. Such configuration may be accomplished in any suitable manner. In some embodiments, imaging system 24 may be directly configured to rotate, such as through the use of a central axis extending through imaging system 24 and/or through rolling engagement between an outer surface of imaging system 24 and an external supporting surface. In other embodiments, imaging system 24 may be mounted to a carrier or drum that is configured to rotate with respect to weapon 22. In still other embodiments, imaging system 24 may be contained within a housing and the housing may be configured to rotate with respect to weapon 22. In still other embodiments, imaging system 24 may be contained within a housing that remains stationary with respect to weapon 22 and is configured to rotate with respect to the housing. Any other suitable configuration that permits imaging system 24 to rotate in elevation with respect to weapon 22 may also be employed.

Imaging system 24 is configured to be operatively coupled with, and to control, a display unit 36. Display unit 36 includes a display 38 that may be configured utilize any display technology capable of displaying graphic images. Imaging system 24 is configured to control display unit 36 to display images of objects detected by imaging system 24. In this manner, potential targets located down range of gun sight 20 may be presented visually to a user of weapon 22. Weapon 22 may include a fire control system that may also be operatively coupled with display unit 36 and that is configured to calculate a firing solution based on the position of weapon 22. In cases where superelevation of weapon 22 is necessary, the firing solution will require a change in the elevation angle of weapon 22. The need to change the elevation angle of weapon 22 may be communicated to a user by movement or relocation of one or more reticles on display 38. When combined with the images presented by imaging system 24, the reticles allow a user to target specific objects down range of weapon 22 and the repositioning of one or more of the reticles on display screen 38 by the fire control system of weapon 22 may signal to the user that superelevation is needed.

Drive mechanism 26 is associated with imaging system 24. Drive mechanism 26 may comprise any suitable type of drive mechanism including, but not limited to, a servo motor; gear train, and/or feedback device including, but not limited to, an angle encoder. Drive mechanism 26 may be mounted to imaging system 24 or to another structure proximate to imaging system 24. Drive mechanism 26 is configured, mounted, and/or arranged so as to cause imaging system 24 to rotate when drive mechanism 26 is actuated. In some embodiments, drive mechanism 26 may be configured to cause imaging system 24 to selectively rotate in either a clockwise or a counter-clockwise direction. In some embodiments, gun sight 20 may include more than one drive mechanism 26 to control rotation of imaging system 24.

Input unit 28 may be any component suitable to receive inputs from the user of weapon 22, from weapon 22 itself, or from some other component. For example, input unit 28 may b configured to receive as an input, an output from a fire control system associated with weapon 22. Input unit 28 is configured to electronically transmit inputs to other systems/components. For example, and without limitation, input unit 28 may be a keyboard, a mouse, a touch screen, a tablet and stylus, a button, a switch, a knob, a slide, a microphone, a camera, a motion detector, a joy stick, a touch pad or any other device that is configured to permit a human to provide inputs into an electronic system. In some embodiments, input unit 28 may be dedicated for use exclusively with gun sight 20. In other embodiments, input unit 28 may be shared by both gun sight 20 and weapon 22. In other embodiments, input unit 28 may be shared with other subsystems associated with weapon 22.

The embodiment illustrated in FIG. 1 includes module 30 which is communicatively coupled with drive mechanism 26, input unit 28 and imaging system 24. Module 30 may comprise a circuit board or circuit card and may be removable to facilitate repair, replacement, and/or upgrades. Module 30 includes processor 32 and electronic memory unit 34 which are also communicatively coupled with drive mechanism 26, input unit 28 and imaging system 24. Processor 32 is configured to cooperate with electronic memory unit 34 to perform the functions described below.

Processor 32 may be any type of computer, controller, micro-controller, circuitry, chipset, computer system, or microprocessor that is configured to perform algorithms, to execute software applications, to execute sub-routines and/or to be loaded with and to execute any other type of computer program. Processor 32 may comprise a single processor or a plurality of processors acting in concert.

Electronic memory unit 34 is an electronic device that is configured to store data. Electronic memory unit 34 may be any suitable data storage component including, without limitation, non-volatile memory, disk drives, tape drives, and mass storage devices and may include any suitable software, algorithms and/or sub-routines that provide the data storage component with the capability to store, organize, and permit the retrieval of data.

The communicative coupling between module 30, on the one hand, and input unit 28, drive mechanism 26, and imaging system 24 on the other hand may be accomplished through the use of any suitable means of transmission including both wired and wireless connections. In the illustrated embodiment, module 30 is directly communicatively coupled to drive mechanism 26, to input unit 28, and to imaging system 24, but it should be understood that in other embodiments, processor module 30 may be indirectly coupled to these components. For example, such communicative couple may be achieved through the use of a communications bus or via the interposition of intervening components. In still other examples, such coupling may be accomplished through the use of wireless communications such as Bluetooth™ communications or through any other suitable short range radio communications without departing from the teachings of the present disclosure.

The communicative coupling between module 30, on the one hand, and drive mechanism 26, input unit 28, and imaging system 24 on the other hand, provides a pathway for the transmission of commands, instructions, interrogations and other signals between these components. Drive mechanism 26, input unit 28, and imaging system 24 may be configured to interface and engage with module 30. For example, drive mechanism 26 may be configured to receive commands from module 30, either directly or indirectly, and may initiate actuation and/or cease actuation in response to such commands. Input unit 28 is configured to provide inputs to module 30 indicative of the initiation of superelevation. For example, a user may actuate input unit 28 when initiating superelevation of weapon 22. Input unit 28 is configured to provide an input to module 30 indicative of such initiation of superelevation.

The stabilization of imaging system 24 by gun sight 20 will now be discussed with reference to FIGS. 1-5.

Module 30 is configured to interact with, coordinate, monitor, and/or orchestrate the activities of drive mechanism 26, input unit 28, and imaging system 24 for the purpose of maintaining imaging system 24 at an angle that maintains a line of sight between imaging system 24 and the object being targeted for engagement by weapon 22 when weapon 22 is being superelevated.

Figure 2:
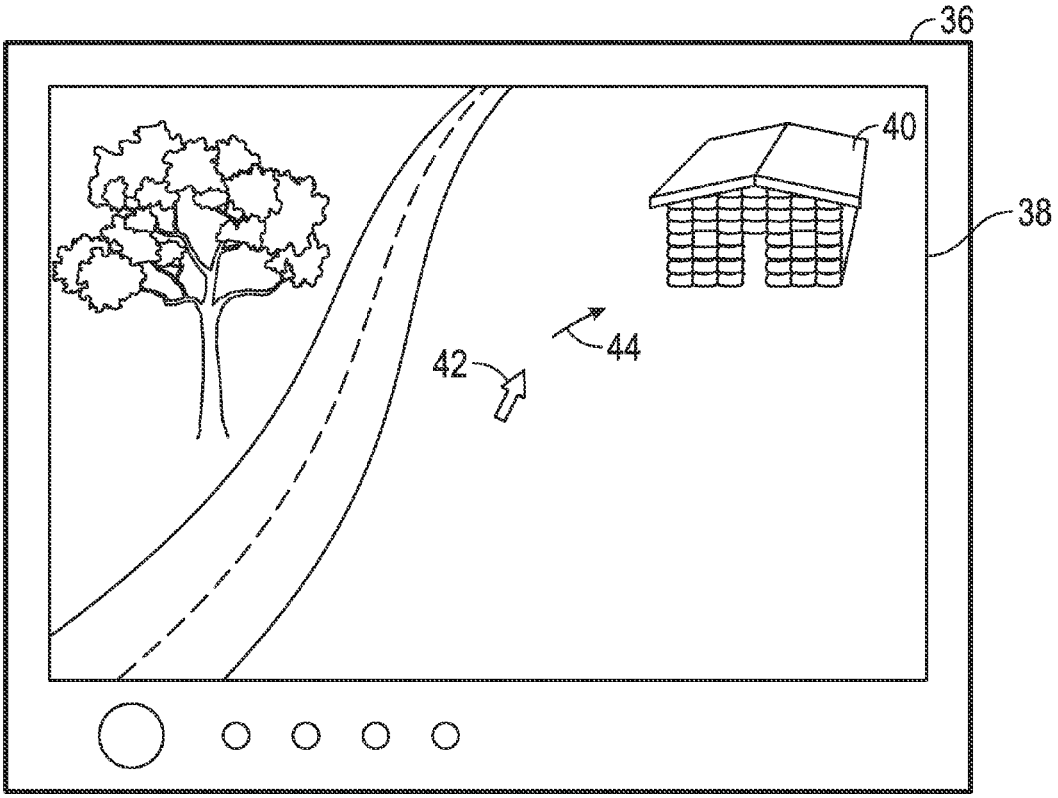
FIG. 2 is a schematic view illustrating a display showing an image detected by the gun sight of FIG. 1.
Figure 3:
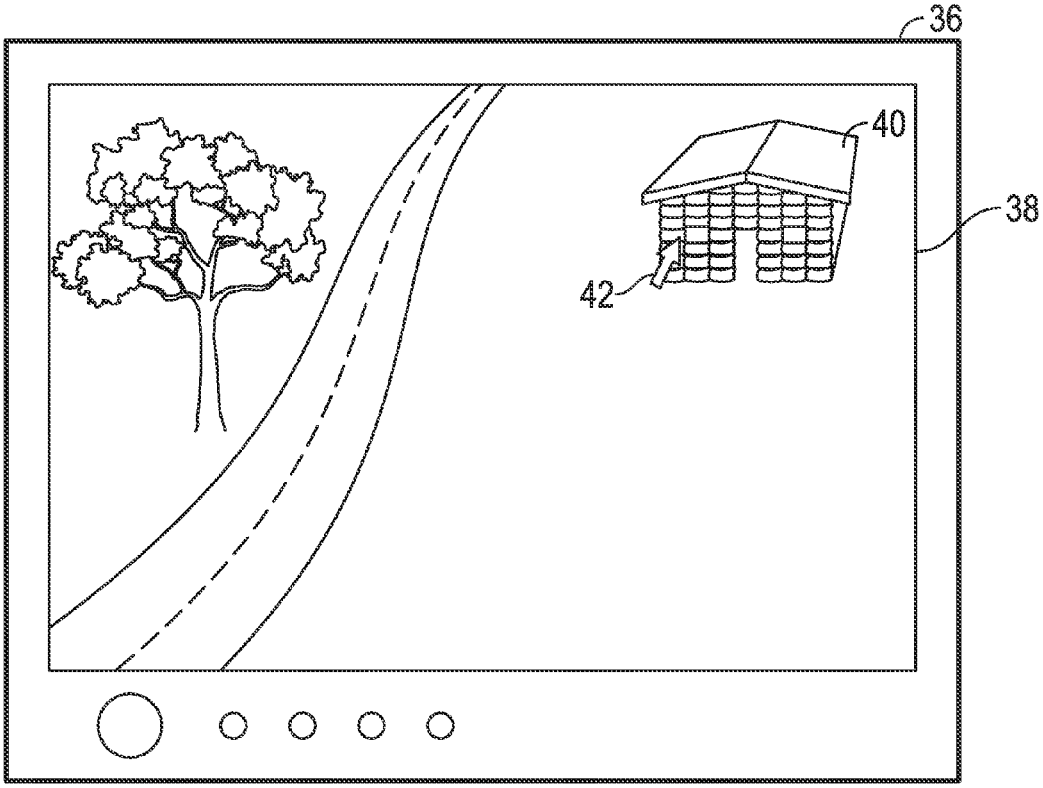
FIG. 3 is a schematic view illustrating the display of FIG. 2 as a user assesses the range to a target.

With reference to FIGS. 2 and 3, when a user observes an object down range of weapon 22 that the user wishes to engage, the user will look into display 38 to find an image 40 of the object. Once the user makes visual contact with image 40, the user will move laser range finding reticle 42 in the direction indicated by arrow 44 until laser range finding reticle 42 is positioned over object 40 (FIG. 3). Once laser range finding reticle 42 is in position, the user may determine the range to the target. The range to the target is provided to the weapon's fire control system which uses various algorithms to determine a firing solution for weapon 22. Once the firing solution has been determined, the user may then use input unit 28 to indicate that superelevation is being initiated.

Figure 4:
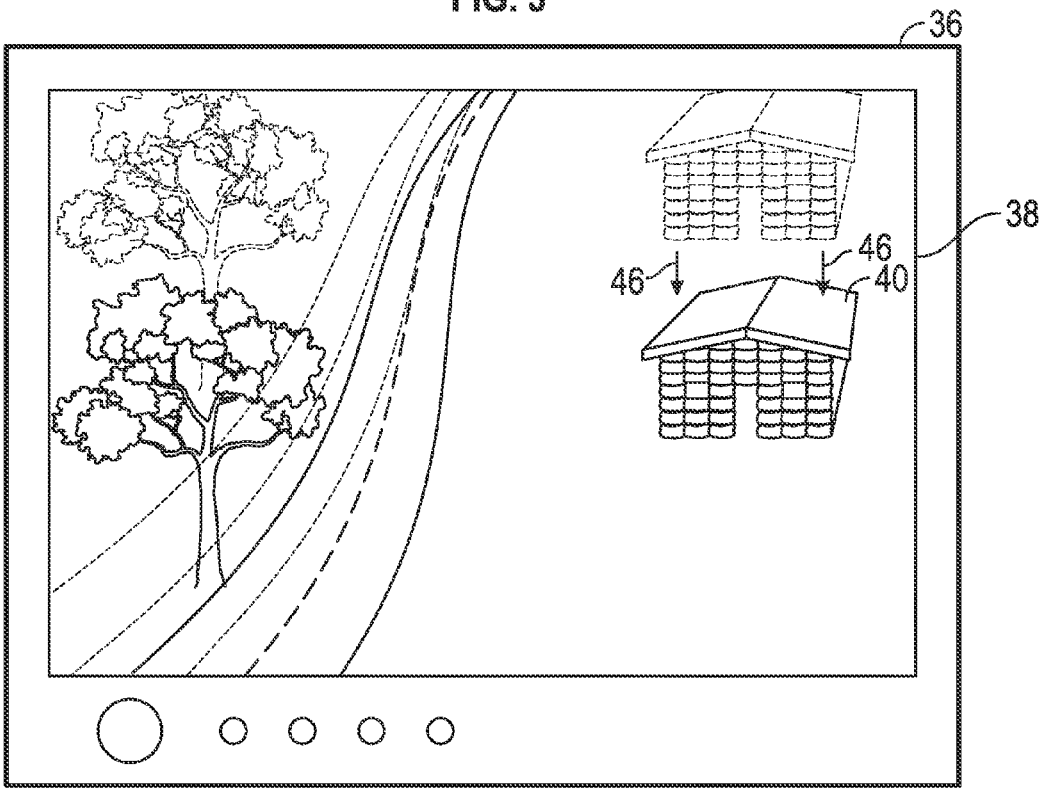
FIG. 4 is a schematic view illustrating the display of FIG. 3 after superelevation of the gun sight has been initiated and the effect of superelevation on the image.

With reference to FIG. 4, the user has begun to superelevate weapon 22. In the example illustrated in FIG. 4, the firing solution requires that the elevation of weapon 22 be raised. As the elevation of weapon 22 is raised, the elevation of gun sight 20 and of imaging system 24 will also be elevated because gun sight 20 is mounted to weapon 22. As imaging system 24 is elevated, the line of sight extending from imaging system 24 will correspondingly be elevated, causing image 40 to begin to move downwardly on display 38, as indicated by arrows 46. For illustration purposes, the image as it appeared prior to superelevation is presented in phantom lines to depict translation of the image in a downward direction on display 38. The image presented in solid lines and the image presented in phantom lines represents two consecutive video frames captured by imaging system 24 (the movement has been exaggerated for illustration purposes).

Figure 5:
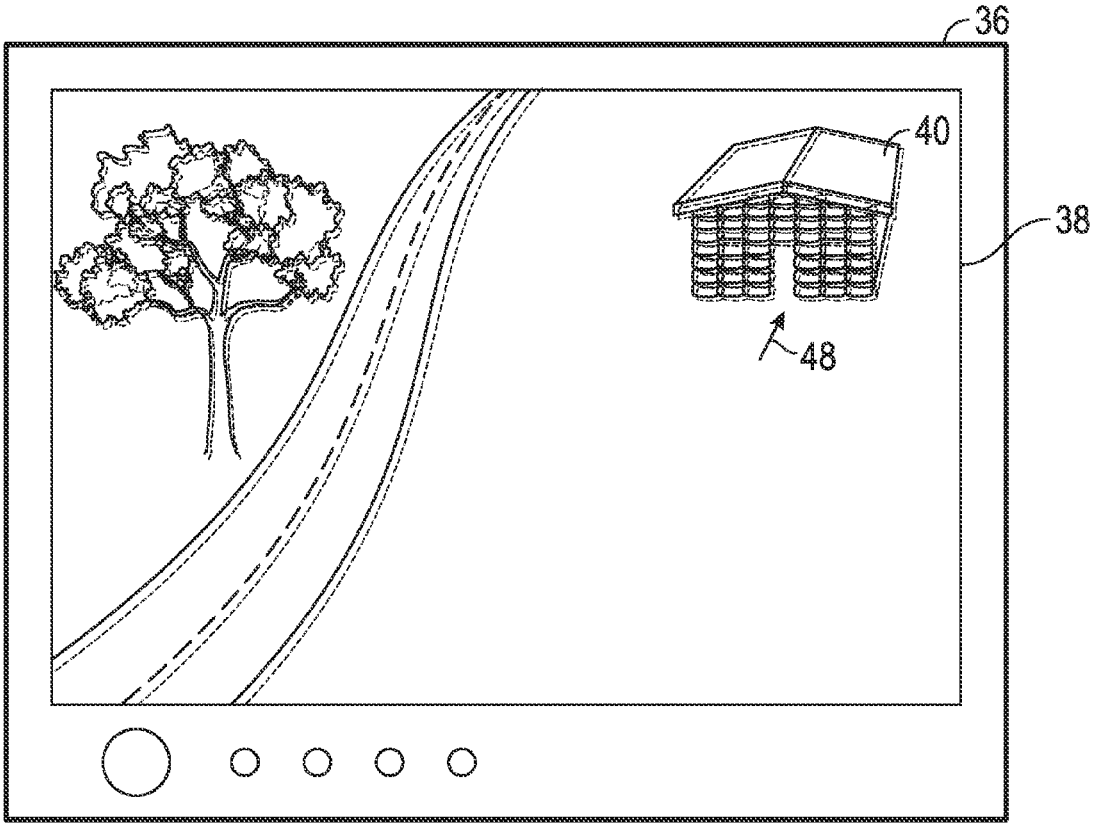
FIG. 5 is a schematic view illustrating the display of FIG. 4 and the effect of the gun sight's tracking of the image during superelevation.

Module 30 is loaded with software that allows it to detect such shifting/translation of image 40 by comparing two or more consecutive video frames collected by imaging system 24. When the image presented by two or more consecutive video frames are out of alignment, module 30 is configured to determine that adjustment of imaging system 24 is necessary. Furthermore, module 30 is configured to determine the direction that weapon 22 is moving in based on the misalignment between the two or more consecutive video frames. This enables module 30 to determine the appropriate direction to move imaging system 24 to offset the change in elevation of weapon 22. Once module 30 has received an input from input unit 28 indicating that superelevation has begun, the software will cause module 30 to compare consecutive video frames to detect the shifting/translation/movement of either a single object within a scene captured by image system 24 or to detect the translation of the entire scene captured by image system 24. As discussed, module 30 does so using information (e.g., consecutive video frames) provided by imaging system 24. While in superelevation mode, as Module 30 compares successive video frames and detects the downward translation of image 40 on display 38, module 30 will control drive mechanism 26 in a manner that offsets the downward translation of image 40. For example, as image 40 moves towards the bottom of display 38, module 30 will provide instructions to drive mechanism 26 that cause drive mechanism 26 to rotate imaging system 24 in manner that lowers its elevation. This, in turn, will depress the line of site of imaging system 24. As a result, image 40 will move on display 38 in an upward direction as indicated in FIG. 5 by arrows 48. As seen in FIG. 5, the image depicted in solid lines has moved upward and is positioned over the image depicted in phantom lines. The phantom line image in FIG. 5 is presented for illustration purposes to demonstrate the stabilizing effect of the counter-rotation of imaging system 24.

This process of image 40 moving in one direction during superelevation, of such movement being detected by module 30, and of module 30 instructing drive mechanism 26 to rotate imaging system 24 in a manner that offsets such movement of image 40 will repeat in an iterative manner as weapon 22 is superelevated. In this manner, the line of sight between imaging system 24 and the targeted object downrange of weapon 22 will be maintained and image 40 will remain in display 38 throughout the entire period that weapon 22 is being superelevated. In some embodiments, module 30 may be configured such that the movement of image 40 on display 38 will be detected by module 30 before such movement is perceptible by humans. This will allow module 30 to correct the line of sight of imaging system 24 in a manner such that image 40 will appear to remain statically in one place as weapon 22 is superelevated. In some embodiments, the software may enable module 30 to anticipate the need for continued rotation of imaging system 24 and to control drive mechanism 26 accordingly, thereby providing for a smooth and/or continuous display of image 40 on display 38.

Figure 6:
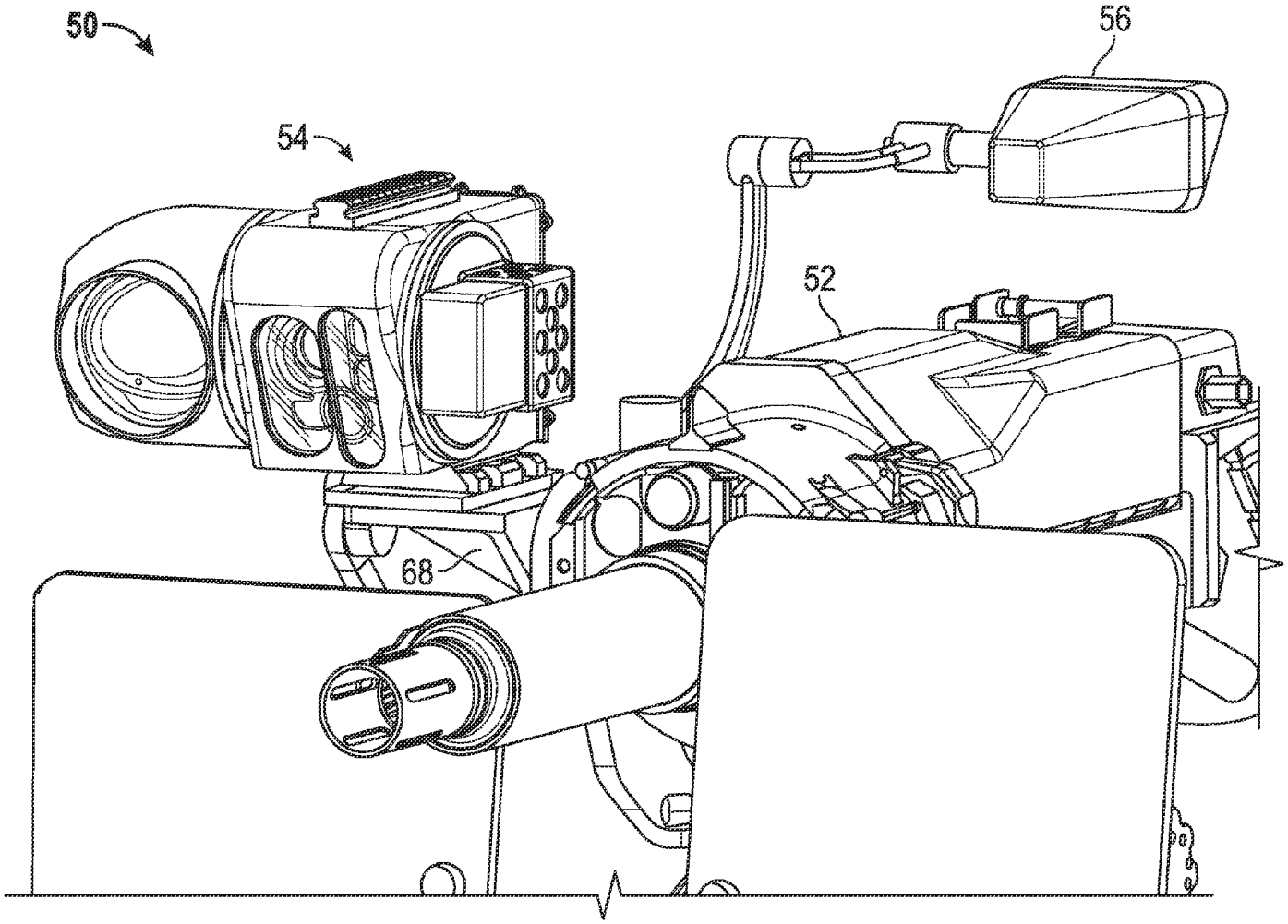
FIG. 6 is a perspective view illustrating a weapon system including the gun sight of FIG. 1.

FIG. 6 is a perspective view of a weapon system 50 including a machine grenade launcher 52, and a gun sight 54. Machine grenade launcher 52 is configured for superelevation and gun sight 54 has been configured to maintain a line of sight with a target as machine grenade launcher 52 is being superelevated. A display unit 56 is illustrated extending from machine grenade launcher 52 and is used by the operator to scan the down field area for targets.

Figure 7:
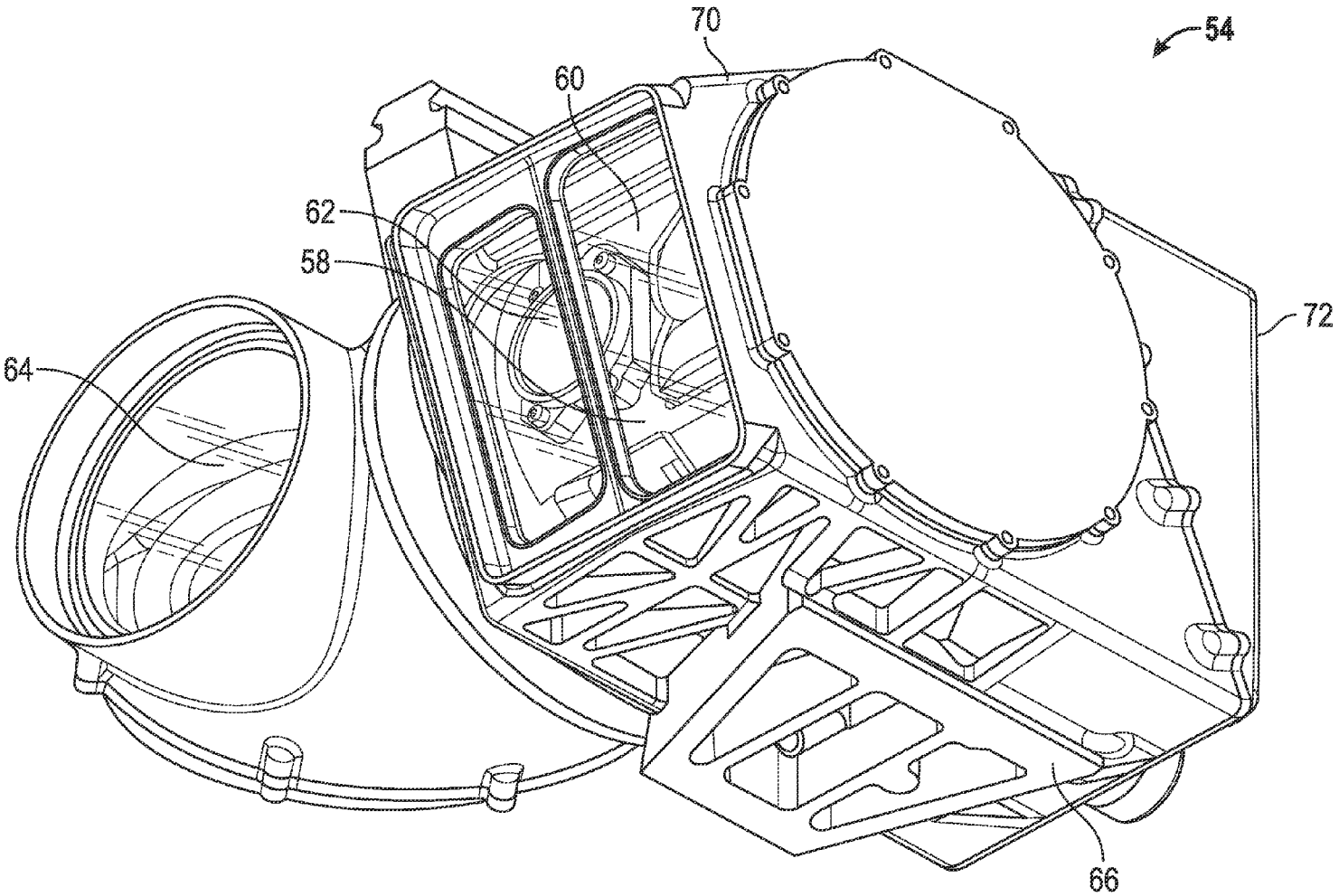
FIG. 7 is an expanded perspective view illustrating the gun sight of FIG. 7.

FIG. 7 is an expanded perspective view of gun sight 54. Gun sight 54 includes an imaging system 58 including three discrete imaging sub-systems; a laser range finder 60, a daylight imaging sub-system 62, and a thermal imaging sub-system 64. With continuing reference to FIG. 6, underside 66 of gun sight 54 is configured to be mounted to machine grenade launcher 52 via mount 68. A housing 70 surrounds imaging system 58 to protect it from the elements. Imaging system 58 is configured to rotate with respect to housing 70 and housing 70 is configured to rotate together with machine grenade launcher 52 when machine grenade launcher 52 is superelevated. Thermal imaging sub-system 64 is physically connected with the remainder of imaging system 58, but extends outside of housing 70. Because of its physical connection to the remainder of imaging system 58, thermal imaging sub-system 64 also rotates with respect to housing 70 during superelevation of machine grenade launcher 52. Circuit card assembly 72 contains various circuit cards and/or controllers and/or processors which may be configured to control the angular orientation of imaging system 58 in the manner discussed above with respect to module 30 of FIG. 1.

Figure 8:
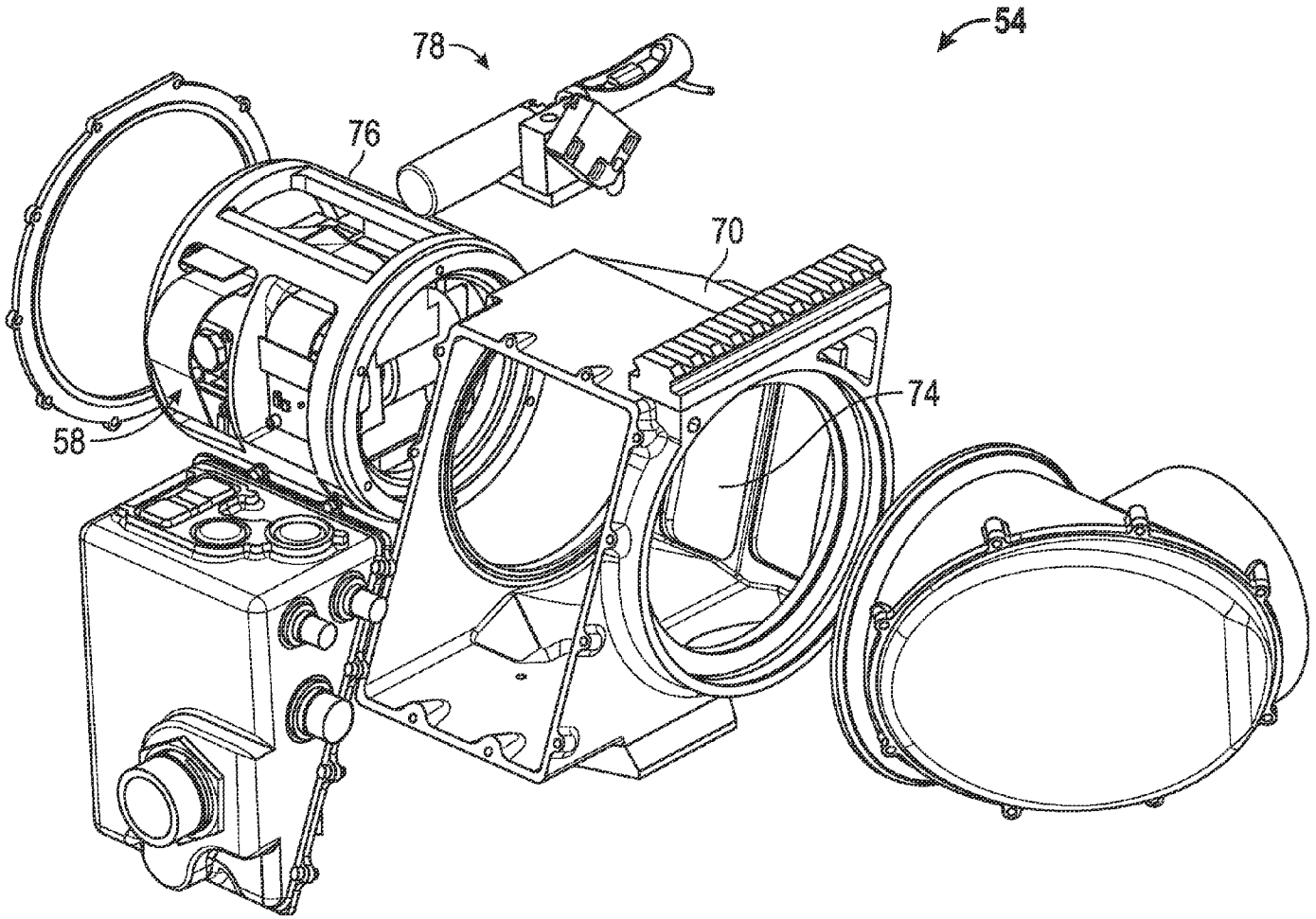
FIG. 8 is an exploded view illustrating the gun sight of FIG. 8.

FIG. 8 is an exploded view of gun sight 54. Housing 70 includes a bore 74 extending laterally through housing 70. Imaging system 58 is mounted within a drum 76. Drum 76 is generally cylindrical in configuration and has a circular cross section. Bore 74 is configured to receive drum 76 and drum 76 is configured to rotate with respect to housing 70 while received within bore 74.

Figure 9:
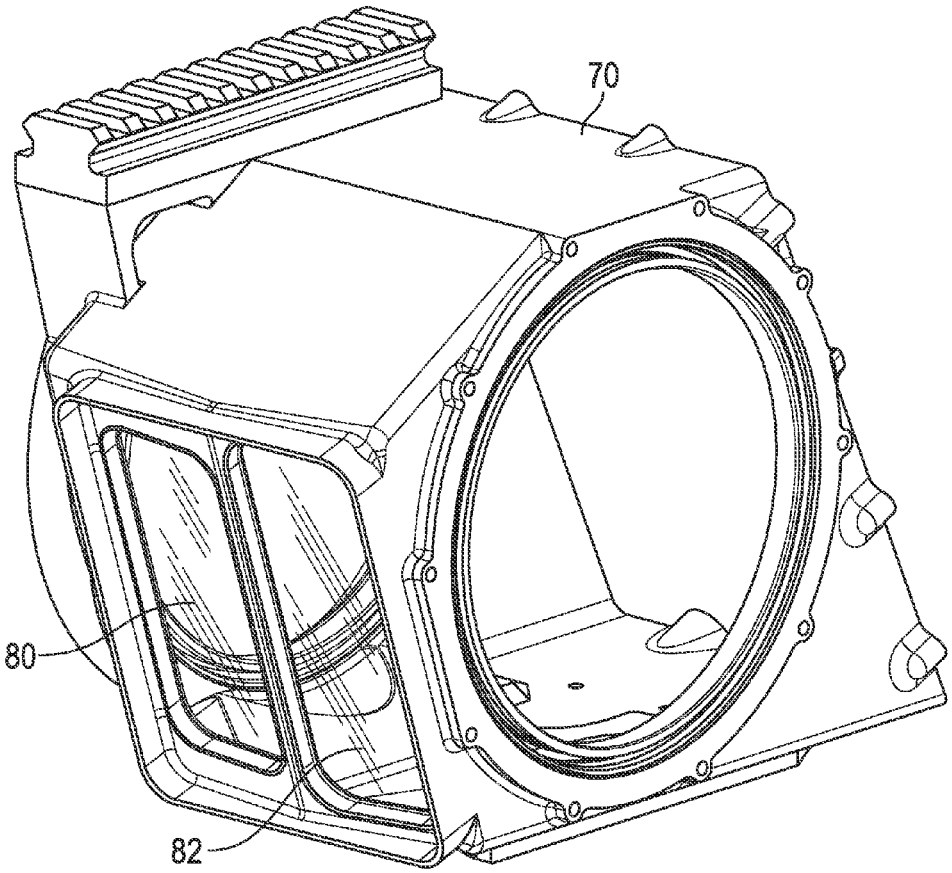
FIG. 9 is an expanded perspective view illustrating a housing for use with the gun sight of FIG. 8.

A drive mechanism 78 is also illustrated in FIG. 9. Drive mechanism 78 is configured to mount to housing 70 and to engage drum 76. When drive mechanism 78 is actuated by circuit card assembly 72, it will cause drum 76 to rotate either clockwise or counter-clockwise, as needed, to maintain imaging system 58 in a manner that maintains the line of sight between imaging system 58 and the targeted object down range of weapon 22 as machine grenade launcher 52 is superelevated.

FIG. 9 is an expanded perspective view of housing 70. Housing 70 includes windows 80 and 82. With continuing reference to FIG. 7, windows 80 and 82 permit laser range finder 60 and daylight imaging sub-system 62 to receive images of the down range area without obstruction, while still permitting the use of dry air or dry nitrogen inside of housing 70 to inhibit fogging of the optical elements comprising imaging system components.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A gun sight for use with a weapon configured for superelevation, the gun sight comprising:

an imaging system configured to capture an image of an area down range of the imaging system, to display the image on a display unit having a display, and further configured to rotate in elevation;

a drive mechanism configured to rotate the imaging system; and a processor communicatively coupled with the drive mechanism and with the imaging system, the processor configured to receive information from the imaging system relating to the image and to control the drive mechanism based on the information to rotate the imaging system in a manner that causes the image to remain on the display when the weapon is superelevated.

2. The gun sight of claim 1, wherein the processor is configured to control the drive mechanism to rotate the imaging system in a manner that causes the image to remain stabilized on the display during superelevation of the weapon.

3. The gun sight of claim 1, wherein the processor is configured to rotate the imaging system in a manner that maintains a line of sight between the imaging system and the area down range of the imaging system.

4. The gun sight of claim 1, further comprising a housing, wherein a portion of the imaging system is mounted within the housing.

5. The gun sight of claim 4, wherein the housing is configured to rotate together with the weapon and wherein the imaging system is configured to rotate with respect to the weapon.

6. The gun sight of claim 4, further comprising a drum, wherein the imaging system is mounted to the drum and wherein the drum is rotatably mounted to the housing.

7. The gun sight of claim 6, wherein the drive mechanism is configured to engage the drum.

8. The gun sight of claim 1, wherein the imaging system comprises a daylight imaging system and a laser range finder.

9. A gun sight for use with a weapon configured for superelevation, the gun sight comprising:

an imaging system configured to capture an image of an area down range of the imaging system, to display the image on a display unit having a display, and further configured to rotate in elevation;

a drive mechanism configured to rotate the imaging system;

an input unit configured to transmit a signal indicative of an initiation of superelevation; and a processor communicatively coupled with the imaging system and the drive mechanism and the input unit, the processor configured to receive the signal from the input unit, to receive information from the imaging system relating to the image, and to control the drive mechanism based on the information to rotate the imaging system in a manner that causes the image to remain on the display when the processor receives the signal.

10. The gun sight of claim 9, wherein the processor is configured to control the drive mechanism to rotate the imaging system in a manner that causes the image to remain stabilized on the display during superelevation of the weapon.

11. The gun sight of claim 9, wherein the processor is configured to rotate the imaging system in a manner that maintains a line of sight between the imaging system and the object.

12. The gun sight of claim 9, further comprising a housing, wherein a portion of the imaging system is mounted within the housing.

13. The gun sight of claim 12, wherein the housing rotates together with the weapon and wherein the imaging system rotates with respect to the weapon.

14. The gun sight of claim 12, further comprising a drum, wherein the imaging system is mounted to the drum and wherein the drum is rotatably mounted to the housing.

15. The gun sight of claim 14, wherein the drive mechanism is configured to engage the drum.

16. A module for use with a gun sight that is configured for use with a weapon capable of superelevation, the weapon including a display unit having a display and the gun sight including an imaging system configured to capture an image of an area downrange of the imaging system and to display the image on the display, and further configured for rotation, the gun sight further including a drive mechanism configured to rotate the imaging system, the module comprising:

a processor; and an electronic memory unit, wherein the module is adapted to communicatively couple with the imaging system and the drive mechanism, and wherein the processor and the electronic memory unit are configured to cooperate to receive information from the imaging system relating to the image, and to control the drive mechanism based on the information to rotate the imaging system in a manner that causes the image to remain on the display when the weapon is superelevated.

17. The gun sight of claim 16, wherein the processor and the electronic memory unit are configured to control the drive mechanism to rotate the imaging system in a manner that causes the image to remain stabilized on the display during superelevation of the weapon.

18. The gun sight of claim 16, wherein the processor is configured to rotate the imaging system in a manner that maintains a line of sight between the imaging system and the object.

* * * * *